US008277908B2

(12) United States Patent
Bala et al.

(10) Patent No.: US 8,277,908 B2
(45) Date of Patent: Oct. 2, 2012

(54) SUBSTRATE FLUORESCENCE MASK FOR EMBEDDING INFORMATION IN PRINTED DOCUMENTS

(75) Inventors: Raja Bala, Webster, NY (US); Reiner Eschbach, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 691 days.

(21) Appl. No.: 11/382,897

(22) Filed: May 11, 2006

(65) Prior Publication Data

US 2007/0264476 A1 Nov. 15, 2007

(51) Int. Cl.
*B41M 5/00* (2006.01)

(52) U.S. Cl. ..... 428/29; 283/92; 428/195.1

(58) Field of Classification Search ..... 428/690, 428/32.76, 195.1, 29; 313/501; 283/92
See application file for complete search history.

(56) References Cited

U.S. PATENT DOCUMENTS

| | | | | |
|---|---|---|---|---|
| 3,614,430 | A | 10/1971 | Berler | |
| 3,870,528 | A | 3/1975 | Edds et al. | |
| 3,900,608 | A | 8/1975 | Dierkes et al. | |
| 4,186,020 | A | 1/1980 | Wachtel | |
| 4,374,643 | A | 2/1983 | Suzuki et al. | |
| 4,384,069 | A | 5/1983 | Wendel et al. | |
| 4,440,846 | A | 4/1984 | Sanders et al. | |
| 4,603,970 | A | 8/1986 | Aota et al. | |
| 4,604,065 | A | 8/1986 | Frazer et al. | |
| 5,042,075 | A | 8/1991 | Sato | |
| 5,256,192 | A | 10/1993 | Liu et al. | |
| 5,286,286 | A | 2/1994 | Winnik et al. | |
| 5,371,126 | A | 12/1994 | Strickler | |
| 5,484,292 | A | 1/1996 | McTaggart | |
| 5,514,860 | A | 5/1996 | Berson | |
| 5,734,752 | A | 3/1998 | Knox | |
| 5,790,703 | A | 8/1998 | Wang | |
| 5,847,713 | A | 12/1998 | Ueda | |
| 6,013,307 | A * | 1/2000 | Hauser et al. | 427/7 |
| 6,057,858 | A | 5/2000 | Desrosiers | |
| 6,106,021 | A | 8/2000 | Phillips | |

(Continued)

FOREIGN PATENT DOCUMENTS

EP 0847016 A2 6/1998

(Continued)

OTHER PUBLICATIONS

Raja Bala et al., U.S. Appl. No. 11/382,869, filed simultaneously herewith, "Substrate Fluorescence Pattern Mask for Embedding Information in Printed Documents".

*Primary Examiner* — Bruce H Hess
*Assistant Examiner* — Ian Rummel
(74) *Attorney, Agent, or Firm* — Fay Sharpe LLP

(57) ABSTRACT

The teachings as provided herein relate to a watermark embedded in an image that has the property of being relatively indecipherable under normal light, and yet decipherable under UV light. This fluorescent mark comprises a substrate containing optical brightening agents, and a first colorant mixture printed as an image upon the substrate. The colorant mixture layer has as characteristics a property of strongly suppressing substrate fluorescence, as well as a property of low contrast under normal illumination against the substrate or a second colorant mixture printed in close spatial proximity to the first colorant mixture, such that the resultant image rendered substrate suitably exposed to an ultra-violet light source, will yield a discernable image evident as a fluorescent mark.

8 Claims, 2 Drawing Sheets

Colorant Mixture 1 = Background
Colorant Mixture 2 = Text

U.S. PATENT DOCUMENTS

| | | | | |
|---|---|---|---|---|
| 6,138,913 | A | 10/2000 | Cyr et al. | |
| 6,252,971 | B1 | 6/2001 | Wang et al. | |
| 6,526,155 | B1 | 2/2003 | Wang et al. | |
| 6,731,409 | B2 | 5/2004 | Wang et al. | |
| 6,731,785 | B1 | 5/2004 | Mennie et al. | |
| 6,773,549 | B1 * | 8/2004 | Burkhardt | 162/137 |
| 6,865,001 | B2 | 3/2005 | Long et al. | |
| 7,070,252 | B2 | 7/2006 | de Queiroz et al. | |
| 7,092,128 | B2 | 8/2006 | Wang et al. | |
| 7,099,019 | B2 | 8/2006 | Silverbrook et al. | |
| 7,126,721 | B2 | 10/2006 | Wang et al. | |
| 7,127,112 | B2 | 10/2006 | Sharma et al. | |
| 7,148,999 | B2 | 12/2006 | Xu et al. | |
| 7,180,635 | B2 | 2/2007 | Wang et al. | |
| 7,198,382 | B2 | 4/2007 | Donovan | |
| 7,213,757 | B2 | 5/2007 | Jones et al. | |
| 7,215,817 | B2 | 5/2007 | de Queiroz et al. | |
| 7,224,489 | B2 | 5/2007 | Loce et al. | |
| 7,286,682 | B1 | 10/2007 | Sharma et al. | |
| 7,324,241 | B2 | 1/2008 | Eschbach et al. | |
| 7,580,153 | B2 | 8/2009 | Eschbach et al. | |
| 7,589,865 | B2 | 9/2009 | Eschbach et al. | |
| 7,614,558 | B2 | 11/2009 | Katsurabayashi et al. | |
| 7,706,565 | B2 | 4/2010 | Levy et al. | |
| 7,800,785 | B2 | 9/2010 | Bala et al. | |
| 2003/0193184 | A1 * | 10/2003 | Taylor et al. | 283/72 |
| 2004/0071359 | A1 * | 4/2004 | Sharma et al. | 382/254 |
| 2005/0152040 | A1 | 7/2005 | Goggins | |
| 2007/0262579 | A1 | 11/2007 | Bala et al. | |
| 2008/0299333 | A1 | 12/2008 | Bala et al. | |
| 2008/0302263 | A1 | 12/2008 | Eschbach et al. | |
| 2008/0304696 | A1 | 12/2008 | Eschbach et al. | |
| 2008/0305444 | A1 | 12/2008 | Eschbach et al. | |
| 2009/0122349 | A1 | 5/2009 | Bala et al. | |

FOREIGN PATENT DOCUMENTS

| | | |
|---|---|---|
| JP | 2194989(A) | 8/1990 |
| JP | 10251570(A) | 9/1998 |
| JP | 2005161792(A) | 8/2005 |

* cited by examiner

FIG. 1
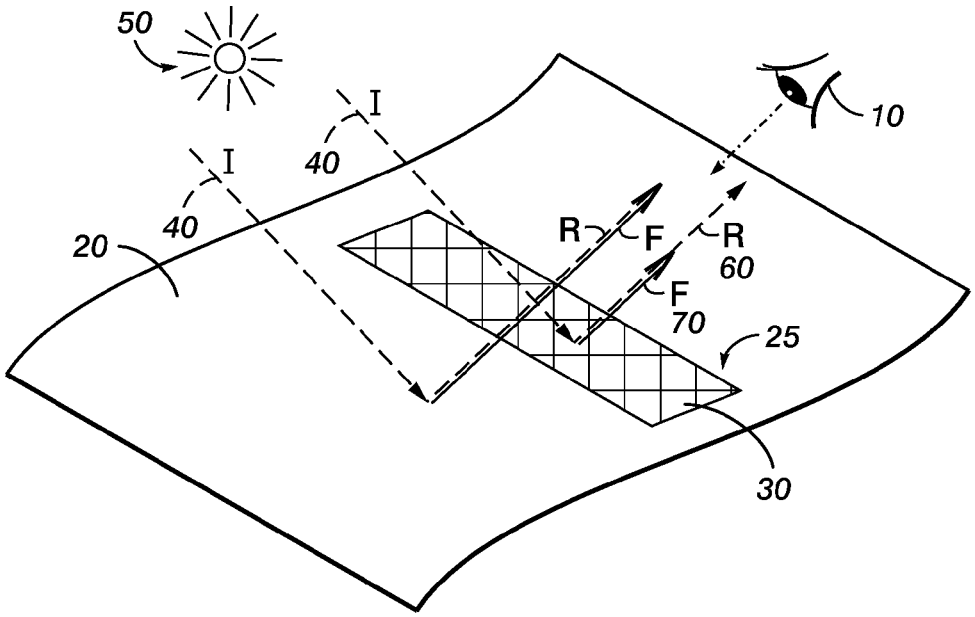
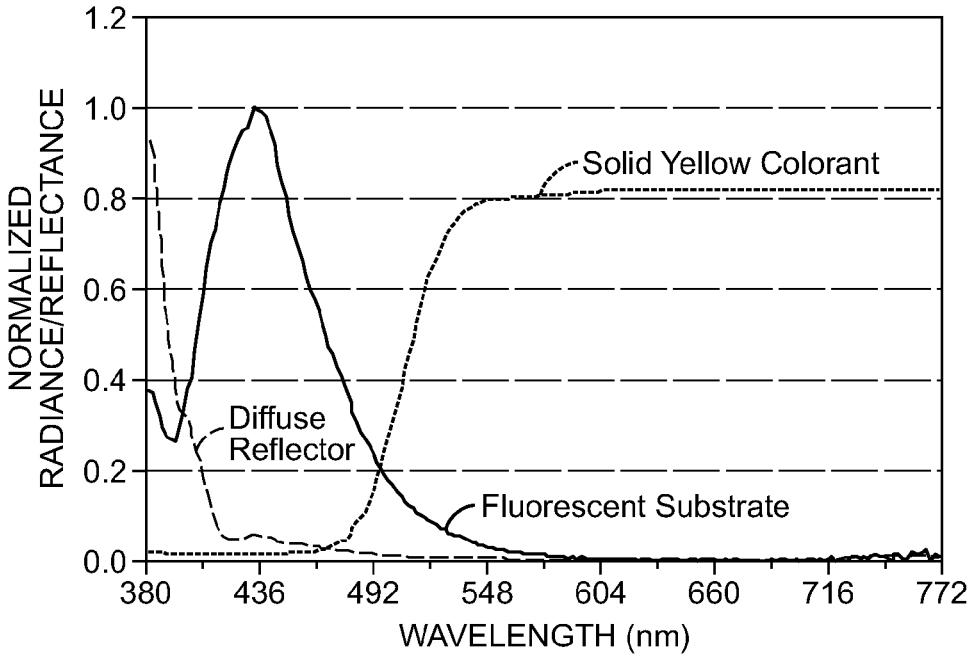
FIG. 2

Colorant Mixture 1 = Background
Colorant Mixture 2 = Text

SUBSTRATE FLUORESCENCE MASK FOR EMBEDDING INFORMATION IN PRINTED DOCUMENTS

CROSS-REFERENCE TO RELATED APPLICATIONS

Cross reference is made to the following application filed concurrently herewith and incorporated by reference herein: Ser. No. 11/382,869, entitled "SUBSTRATE FLUORESCENCE PATTERN MASK FOR EMBEDDING INFORMATION IN PRINTED DOCUMENTS".

BACKGROUND AND SUMMARY

The present invention in various embodiments relates generally to the useful manipulation of fluorescence found in substrates and particularly most paper substrates as commonly utilized in various printer and electrostatographic print environments. More particularly, the teachings provided herein relate to at least one realization of fluorescence watermarks.

It is desirable to have a way to provide detection of the counterfeiting, illegal alteration, and/or copying of a document, most desirably in a manner that will provide document security and which is also applicable for digitally generated documents. It is desirable that such a solution also have minimum impact on system overhead requirements as well as minimal storage requirements in a digital processing and printing environment. Additionally, it is highly desirable that this solution be obtained without physical modification to the printing device and without the need for costly special materials and media.

Watermarking is a common way to ensure security in digital documents. Many watermarking approaches exist with different trade-offs in cost, fragility, robustness, etc. One approach is to use ultra-violet (UV) ink rendering, to encode a watermark that is not visible under normal illumination, but revealed under UV illumination. The traditional approach, often used in currency notes, is to render a watermark with special ultra-violet (UV) fluorescent inks and to subsequently identify the presence or absence of the watermark in a proffered document using a standard UV lamp. One example of this approach may be found in U.S. Pat. No. 5,286,286 to Winnik et al., which is herein incorporated by reference in its entirety for its teachings. However, these inks are costly to employ, and thus are typically only economically viable in offset printing scenarios, and thus only truly avail themselves of long print runs. Additionally, these materials are often difficult to incorporate into standard electro-photographic or other non-impact printing systems like solid ink printers, either due to cost, availability or physical/chemical properties. This in turn discourages their use in variable data printing arrangements, such as for redeemable coupons, for but one example.

Another approach taken to provide a document for which copy control is provided by digital watermarking includes as an example U.S. Pat. No. 5,734,752 to Knox, where there is illustrated a method for generating watermarks in a digitally reproducible document which are substantially invisible when viewed including the steps of: (1) producing a first stochastic screen pattern suitable for reproducing a gray image on a document; (2) deriving at least one stochastic screen description that is related to said first pattern; (3) producing a document containing the first stochastic screen; (4) producing a second document containing one or more of the stochastic screens in combination, whereby upon placing the first and second document in superposition relationship to allow viewing of both documents together, correlation between the first stochastic pattern on each document occurs everywhere within the documents where the first screen is used, and correlation does not occur where the area where the derived stochastic screens occur and the image placed therein using the derived stochastic screens becomes visible.

For each of the above patents and citations the disclosures therein are totally incorporated herein by reference in their entirety.

Disclosed in embodiments herein is a fluorescent mark indicator comprising a substrate containing optical brightening agents and, a colorant layer deposited upon the substrate to create an image upon the substrate. The colorant layer has as characteristics a property of high suppression of substrate fluorescence, as well as a property of low contrast against the paper substrate under normal illumination, whereby the resultant substrate image suitably exposed to an ultra-violet light source, will yield a discernable pattern evident as a fluorescent mark.

Further disclosed in embodiments herein, is a fluorescent mark indicator comprising a paper substrate containing optical brightening agents, and a first colorant mixture printed as an image upon the paper substrate, the first colorant mixture providing a property of relatively high suppression of substrate fluorescence. The mark indicator further comprises a second colorant mixture printed as an image upon the paper substrate in substantially close spatial proximity to the printed first colorant mixture, the second colorant mixture providing a property of relatively low suppression of substrate fluorescence, and a property of low contrast against the first colorant mixture, such that the resultant colorant patterned paper substrate suitably exposed to an ultra-violet light source, will yield a discernable image evident as a fluorescent mark.

Further disclosed in embodiments herein, is a system for creating a fluorescence mark comprising a paper substrate containing optical brightening agents, and a digital color printing system. The digital color printing system further comprising at least one first colorant mixture that exhibits a property of high absorption of substrate fluorescence under ultra-violet light, and at least one second colorant mixture that exhibits a property of low absorption of substrate fluorescence under ultra-violet light as well as a property of low contrast as compared against the at least one first colorant mixture under normal illumination. The system further comprising a color image printed with the digital color printing system on the paper substrate, the color image comprising at least said first colorant mixture and said second colorant mixture arranged in close spatial proximity to each other, the spatial arrangement of the at least two colorant patterns revealing a fluorescence mark when the printed color image is viewed under ultraviolet light.

BRIEF DESCRIPTION OF THE DRAWINGS

FIG. 1 schematically depicts the resultant observable light from a substrate and colorant patch thereupon.

FIG. 2 shows a graph of normalized radiance and reflectance as a function of wavelength for a solid yellow colorant, a fluorescent substrate, and a diffuse reflector.

DETAILED DESCRIPTION

Figure 3:
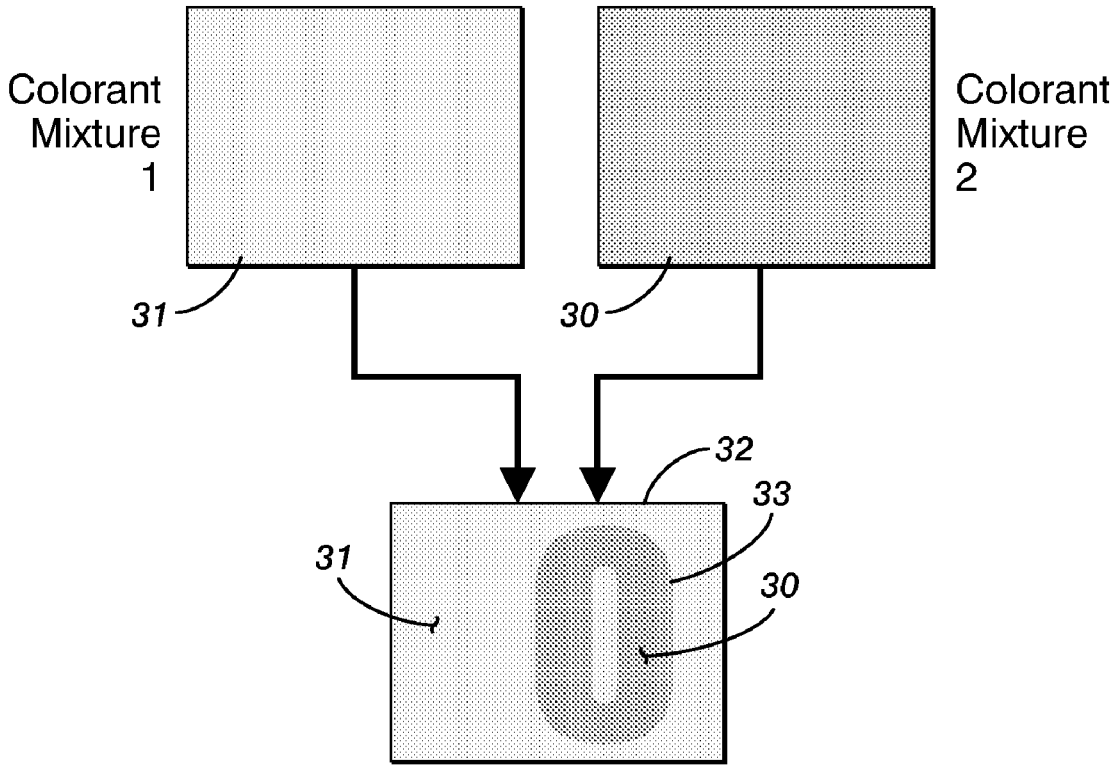
FIG. 3 provides depiction of the principle teachings provided herein as applied to the rendering of an example alphanumeric character.

For a general understanding of the present disclosure, reference is made to the drawings. In the drawings, like reference numerals have been used throughout to designate identical elements. In describing the present disclosure, the following term(s) have been used in the description.

The term "data" refers herein to physical signals that indicate or include information. An "image", as a pattern of physical light or a collection of data representing said physical light, may include characters, words, and text as well as other features such as graphics. A "digital image" is by extension an image represented by a collection of digital data. An image may be divided into "segments," each of which is itself an image. A segment of an image may be of any size up to and including the whole image. The term "image object" or "object" as used herein is believed to be considered in the art generally equivalent to the term "segment" and will be employed herein interchangeably. In the event that one term or the other is deemed to be narrower or broader than the other, the teaching as provided herein and claimed below is directed to the more broadly determined definitional term, unless that term is otherwise specifically limited within the claim itself.

In a digital image composed of data representing physical light, each element of data may be called a "pixel," which is common usage in the art and refers to a picture element. Each pixel has a location and value. Each pixel value is a bit in a "binary form" of an image, a gray scale value in a "gray scale form" of an image, or a set of color space coordinates in a "color coordinate form" of an image, the binary form, gray scale form, and color coordinate form each being a two-dimensional array defining an image. An operation performs "image processing" when it operates on an item of data that relates to part of an image. "Contrast" is used to denote the visual difference between items, data points, and the like. It can be measured as a color difference or as a luminance difference or both. A digital color printing system is an apparatus arrangement suited to accepting image data and rendering that image data upon a substrate.

For the purposes of clarity for what follows, the following term definitions are herein provided:

- Colorant: one of the fundamental subtractive C, M, Y, K, primaries, (cyan, magenta, yellow, and black)—which may be realized in formulation as, liquid ink, solid ink, dye, or electrostatographic toner.
- Colorant mixture: a particular combination of C, M, Y, K colorants.
- Fluorescence mark: A watermark embedded in the image that has the property of being relatively indecipherable under normal light, and yet decipherable under UV light.

There is well established understanding in the printing industry regarding the utilization of fluorescent material inks in combination with ultra-violet light sources as employed for security marks, particularly as a technique to deter counterfeiting. See for example: U.S. Pat. No. 3,611,430 to Berler; U.S. Pat. No. 4,186,020 to Wachtel; and U.S. Pat. No. 5,256,192 to Liu et al., each of which is hereby incorporated by reference in its entirety for its teaching. However, there remains a long standing need for an approach to such a technique which will provide the same benefit but with lower complexity and cost, particularly in a digital printing environment, and using only common consumables as well. Herein below, teaching is provided regarding how the fluorescent properties found in paper substrates, may be suitably masked by the toners applied thereupon so as to render a distinct image viewable under ultra-violet light, and which otherwise may never-the-less, escape the attention of an observer under normal lighting.

FIG. 1 shows how the human eye of an observer 10 will respond to the reflectance characteristics of bare paper substrate 20 versus the reflectance characteristics of a patch 25 of suitably selected colorant or colorant mixture 30 as deposited upon the same substrate 20. The "I" term depicted as dashed arrows 40 represents incident light directed from light source 50. The "R" term depicted as dashed arrows 60 represents normal reflection, while the "F" term depicted as solid arrows 70 represents the radiated fluorescence from substrate 20 caused by the UV component in the incident light from light source 50.

As can be seen in FIG. 1, incident light 40 when it strikes an open area of the substrate 20 provides amounts both of normal light reflection as well as radiated fluorescence. However, when incident light 40 strikes patch 25 of suitably selected deposited colorant mixture 30 there can be significantly less radiated fluorescence 70, than there is of normal reflection 60 depending on the colorant or colorant mixture chosen. One example of a suitably selected colorant 30 providing significantly less radiated fluorescence is a yellow toner as employed in electrostatographic, ink-jet, and wax based printing apparatus. In the alternative however, other colorants or colorant mixtures may be selected for rendering which do not suppress the radiated fluorescence of the substrate 20 as strongly, such as for example a cyan or magenta colorant.

FIG. 2 provides a graph of light wavelength versus normalized radiance/reflectance. The spectrum data here was obtained by placing a typical substrate in a light booth illuminated with purely UV light, and measuring the reflected radiance with a Photoresearch PR705 spectroradiometer. As a reference, the figure also includes the spectral radiance from a non-fluorescent barium-sulfate diffuse reflector. It is clearly seen that the fluorescence spectrum has most of its energy in the shorter (or "blue") wavelengths. As may be seen in FIG. 2, by examining the radiance of a fluorescent substrate (as represented by the solid trace line here), it can be seen that the normalized radiance of a typical white substrate 20 peaks at approximately 436 nanometers. OBA (optical brightening agents) are commonly employed in the manufacture of white paper to make the paper whiter and are found in amounts corresponding to the "whiteness" or "brightness" of the paper. See for example: U.S. Pat. No. 3,900,608 to Dierkes et al.; U.S. Pat. No. 5,371,126 to Strickler; or U.S. Pat. No. 6,773,549 to Burkhardt, each of which is hereby incorporated by reference in its entirety for its teaching. Indeed paper is now often marketed with a numeric indication of its brilliance. Virtually all xerographic substrates contain some amount of OBAs. Indeed it should be noted that other colored paper substrates have been found to exhibit similar properties in differing amounts. Yellow paper in particular has been empirically found to be comparable to many white paper substrates.

In distinction with the fluorescing substrate, the solid yellow colorant (as indicated by the dotted line in FIG. 2) provides very low radiance/reflectance of the light fluorescing in the paper substrate for the range below approximately 492 nanometers. In effect a yellow colorant deposited upon a fluorescing substrate masks the fluorescing of that substrate where so deposited. Note as point of reference the response for a diffuse reflector (indicated in FIG. 2 as a dashed line). As noted above, the response for other colorants differs from the yellow colorant. A listing of the approximate comparative quality of the C, M, Y, and K, colorants as to their UV masking and perceived relative luminance characteristics is provided in the following table:

| Toner Colorant | UV Absorption/ Fluorescence Suppression | Blue Absorption | Perceived Intensity Absorption or Perceived Luminance Impact |
|---|---|---|---|
| Black | High | High | High |
| Cyan | Low-medium | Low | High |
| Magenta | Low-medium | Medium | Medium |
| Yellow | High | High | Low |

The above noted and described teachings when suitably employed, present a UV-based watermarking technique that as taught herein uses only common consumables. The technique is based on the following observations: 1) common substrates used in digital printing contain optical brighteners that cause fluorescence; 2) the standard colorants act as an effective blocker of UV-induced emission, with the yellow colorant commonly being the strongest inhibitor; 3) the yellow colorant in addition to being a strong inhibitor of UV-induced emission, also exhibits very low luminance contrast under normal illumination. This is because yellow absorbs in the blue regime of the visible spectrum, and blue does not contribute significantly to perceived luminance.

The technique as taught herein works by finding colorant patterns that produce similar R (normal reflection) and thus are hard to distinguish from each other under normal light, while also providing very dissimilar F (radiated fluorescence) and thus displaying a high contrast from one another under UV light. In one example embodiment, this makes the yellow colorant an ideal candidate for embedding information in a document printed on a typical white fluorescent substrate. When viewed under normal lighting, the yellow watermark is difficult if not impossible to see. When viewed under UV light, the watermark is revealed due to the fact that yellow colorant exhibits high contrast against the fluorescent substrate. This effect is even greater when the yellow colorant is printed upon a yellow paper substrate. Since the technique uses only common substrates and colorants, it is a cost-effective way of ensuring security markings in short-run/customized digital printing environments. Additionally, there are a wide variety of UV light sources, many of them inexpensive and portable, thus making the detection of a fluorescence mark in the field easy and convenient.

Note that the proposed technique is distinct from the conventional offset approach in that instead of fluorescence emission being added via application of special inks, fluorescence emission from the substrate is being subtracted or suppressed using yellow or some other colorant or colorant mixture. In that sense, the technique described herein is the logical 'inverse' of existing methods; rather than adding fluorescent materials to parts of a document, a selective suppression or masking of the substrate fluorescence effect is employed instead.

To quantify the contrast induced by the yellow colorant, several luminance measurements were made of solid yellow vs. plain substrate used in a XEROX® DocuColor12™ printer. Two substrates were selected: Substrate 1 contains a large amount of optical brightener, and Substrate 2 contains very little optical brightener. Luminance measurements were made under three illuminants: i) D50 ii) UV iii) D50 with a blue filter. The latter was intended to represent a known practice of using the blue channel to extract information in the yellow colorant. The luminance ratio $Y_{white}/Y_{yellow}$ was used as a simple measure of contrast or dynamic range exhibited by the yellow colorant. The data is summarized in the following table:

Luminance dynamic range obtained from yellow on white paper under different illuminants.

| | $Y_{paper}/Y_{yellow}$ | |
|---|---|---|
| | Substrate 1 (high fluorescence) | Substrate 2 (low fluorescence) |
| D50 (Daylight) | 1.23 | 1.15 |
| UV | 12.7 | 1.61 |
| D50 with blue filter | 6.89 | 5.09 |

Several observations can be made from this data: 1) The contrast obtained from yellow on a fluorescent substrate increases by an order of magnitude when switching from daylight to UV illumination. This suggests that yellow can act as an effective watermark on fluorescent substrate, and UV light can be used as the "watermark key"; 2) Under UV illumination alone, the substrate fluorescence plays a significant role in the resulting contrast. This is evidenced in the second row of the table. Thus, the substrate is a contributor in the proposed watermarking process, i.e. if a user illegally reproduces a document on the wrong type of substrate, the visibility of the watermark will be affected; and, 3) The contrast achieved by a fluorescent substrate under UV is about twice that achieved with a standard blue filter. This indicates that the fluorescence-based approach can be far more effective than standard approaches that use data only from the visible spectrum.

FIG. 3 provides depiction for application of the principle teachings enumerated above. In FIG. 3, a colorant mixture-1 is selected and applied to patch area 33, which here is arranged in this example as the alphanumeric symbol "O". Further, a colorant mixture-2 is selected and applied to patch area 32 arranged here in substantially close spatial proximity to patch area 33, and thereby effecting a background around patch area 33. Both colorant mixture-1 and mixture-2 are comprised of suitably selected colorant or colorant mixtures 31 and 30 respectively.

Each colorant mixture 31 or 30 may be either a single CMYK colorant or any mixture of CMYK colorants. They will however, not both be comprised of the same identical single colorant or colorant mixture. Indeed for example, in one embodiment, colorant mixture 31 will be selected so as to provide higher fluorescence absorption than that selected for colorant mixture 30. However, in a preferred arrangement the colorant mixtures 30 and 31 will be selected most optimally to match each other closely in their average color or luminance under normal light, while at the same time differing in their average fluorescence absorption.

For example an approximate 50% grayscale gray colorant mixture may be realized with a halftone of black colorant only. This may then be matched against a colorant mixture comprising a high amount of yellow mixed with enough cyan and magenta to yield a similar approximate 50% grayscale gray colorant mixture. However, with the given high content of yellow colorant amount this matched mixture will provide much higher absorption of UV or suppression of native substrate fluorescence. Thus and thereby two colorant mixtures may be realized which while appearing quite nearly identical under normal viewing illumination, will never-the-less appear quite different under UV lighting.

Further, as will be understood by those skilled in the art, this may be approached as an intentional exploitation of metamerism to reproduce the same color response from two different colorant mixtures under normal viewing illumination. Mixtures which are optimized to vary sufficiently in their average fluorescence absorption and are otherwise a close metameric match under normal room lighting.

Thus as discussed and provided above is a watermark embedded in an image that has the property of being relatively indecipherable under normal light, and yet decipherable under UV light. This fluorescent mark comprises a substrate containing optical brightening agents, and a first colorant mixture printed as an image upon the substrate. The colorant mixture has as characteristics, a property of high absorption of ultra-violet light, as well as a property of low luminance contrast under normal illumination against the paper substrate or a second colorant mixture exhibiting low absorption of ultra-violet light, and printed in close spatial proximity to the first colorant mixture, such that the resulting printed substrate suitably exposed to an ultra-violet light source, will yield a discernable pattern evident as a fluorescent mark.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A system for creating a fluorescent mark, comprising:

a substrate, an optical brightening agent, a metameric image rendered from a first combination of non-fluorescing colorants applied to the substrate and a metameric background rendered from a second, different combination of non-fluorescing colorants applied to the substrate;

wherein one of the first and second combinations render a suppressed radiated fluorescence and remaining of he first and second combinations is adapted to reflect light fluorescing off of the substrate under UV light;

wherein the first and second combinations are a color match under normal light and have a dissimilar radiated fluorescence under the UV light, a contrast of the one combination against the fluorescing substrate under the UV light renders the reflectance as an authenticating mark.

2. The system for creating a fluorescence mark of claim 1 where the first non-fluorescent colorant includes yellow.

3. The system for creating a fluorescence mark of claim 2 where the second non-fluorescent colorant includes magenta.

4. The system for creating a fluorescence mark of claim 2 where the second non-fluorescent colorant includes cyan.

5. The system for creating a fluorescence mark of claim 1 further comprising where the first non-fluorescent colorant is a grayscale value comprised of black colorant, and the second non-fluorescent colorant is included in a mixture comprised of a first yellow colorant, a second cyan colorant, and a third magenta colorant to make a similar grayscale value match to the first non-fluorescent colorant mixture grayscale value.

6. The system for creating a fluorescence mark of claim 1 further comprising where the first non-fluorescent colorant and a mixture including the second non-fluorescent colorant are a metameric color match under normal illumination but differ in their response under ultra-violet light.

7. The system for creating a fluorescent mark of claim 1 further comprising where the first non-fluorescent colorant and a mixture including the second non-fluorescent colorant mixture are selected to minimize any difference between them in their average luminance value under normal light, while also maximizing any difference in their average substrate fluorescence suppression under the UV illuminant.

8. The authenticate document of claim 1, wherein the non-fluorescing colorants include toner colorants applied to the substrate in amounts realized with halftones based on pixel values.

* * * * *